US012553619B2

(12) United States Patent
Vehslage

(10) Patent No.: US 12,553,619 B2
(45) Date of Patent: Feb. 17, 2026

(54) COOKING APPLIANCE HAVING A VENTILATION SYSTEM

(71) Applicant: WHIRLPOOL CORPORATION, Benton Harbor, MI (US)

(72) Inventor: David Vehslage, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 580 days.

(21) Appl. No.: 17/837,201

(22) Filed: Jun. 10, 2022

(65) Prior Publication Data

US 2023/0400193 A1 Dec. 14, 2023

(51) Int. Cl.
*F24C 15/20* (2006.01)

(52) U.S. Cl.
CPC ..... *F24C 15/2042* (2013.01); *F24C 15/2021* (2013.01)

(58) Field of Classification Search
None
See application file for complete search history.

(56) References Cited

U.S. PATENT DOCUMENTS 5,279,279 A 1/1994 White
6,276,358 B1 8/2001 Brin, Jr. et al.
6,455,818 B1 * 9/2002 Arntz ..... F24C 15/2042 126/299 R
7,836,877 B2 11/2010 Gagas et al.
9,297,540 B2 3/2016 Sinur et al.
2005/0224069 A1 * 10/2005 Patil ..... F24C 15/2021 126/299 D
2006/0150965 A1 7/2006 Kim et al.
2007/0062513 A1 * 3/2007 Gagas ..... G01G 3/16 126/299 D
2018/0266695 A1 * 9/2018 Yu ..... F24C 3/122
(Continued)

FOREIGN PATENT DOCUMENTS

CN 114251699 A * 3/2022 ..... F24F 11/77
DE 102017213582 B4 2/2021
(Continued)

OTHER PUBLICATIONS

Machine Translation of CN 114251699 (Year: 2022).*
(Continued)

*Primary Examiner* — Allen R. B. Schult
*Assistant Examiner* — Amy E Carter
(74) *Attorney, Agent, or Firm* — McGarry Bair PC

(57) ABSTRACT

A cooking appliance includes a ventilation system having a duct in fluid communication with a vent opening defined in a cooking surface. A set of first louvers and a set of second louvers are disposed in the duct and selectively moveable between a respective first position and second position. A blower motor with a selectable speed of operation is in fluid communication with duct. A controller module is operative to receive a first signal indicative of a value of a first parameter from a user interface, receive a second signal indicative of a measured a value of a second parameter from a sensor, and to selectively trigger a change in the blower motor speed of operation, position of the set of first louvers, or the position of the set of second louvers, based on the value of the first parameter and the second parameter.

20 Claims, 5 Drawing Sheets

(56) References Cited

U.S. PATENT DOCUMENTS

| | | | | |
|---|---|---|---|---|
| 2020/0182484 | A1 | 6/2020 | Cowan et al. | |
| 2021/0041112 | A1* | 2/2021 | Pi | A47J 37/0754 |
| 2023/0031687 | A1* | 2/2023 | Sinur | F24C 15/2021 |

FOREIGN PATENT DOCUMENTS

| | | | | |
|---|---|---|---|---|
| DE | 102019125683 | A1 * | 3/2021 | F24C 15/2064 |
| DE | 102020124068 | A1 * | 3/2022 | F24C 15/2042 |
| EP | 4198401 | A1 | 6/2023 | |
| ES | 2781248 | A1 | 8/2020 | |
| JP | H03207925 | A | 9/1991 | |

OTHER PUBLICATIONS

Machine Translation of DE 102019125683 (Year: 2021).*
Machine Translation of DE 102020124068 (Year: 2022).*
Extended European Search Report for Counterpart EP23178286.3, Dated Oct. 11, 2023, 17 Pages.

* cited by examiner

COOKING APPLIANCE HAVING A VENTILATION SYSTEM

TECHNICAL FIELD

The present disclosure generally relates to a cooking appliance and a method of operating the cooking appliance, and more specifically to a ventilation system for a cooking appliance.

BACKGROUND OF THE INVENTION

Many different types of cooking appliances produce smoke, steam, or other gaseous contamination during use. Often, it is considered beneficial to utilize some type of ventilation system to evacuate the air borne contamination, either upward through a venting hood or downward into a draft flue. In kitchens, most known venting arrangements take the form of a hood which is fixed above a cooking surface and which can be selectively activated to evacuate the contaminated air. Downdraft vent arrangements are also commonly used with a cooking surface that incorporates a vent opening that is positioned between different sections of the cooking surface or extends along a back of the cooking surface. The downdraft vents can either be fixed relative to the cooking surface or can be selectively raised relative to the cooking surface to an operating position.

However, because of the natural tendency of cooking emissions to flow vertically upward from the cooking appliance, and because of the arrangement of downdraft vents adjacent to, but not above, the emission plume, improvements to the emission capture capability of downdraft ventilation systems is desirable.

BRIEF SUMMARY OF THE INVENTION

In one aspect, the present disclosure relates to a cooking appliance. The cooking appliance can include a cooking surface having a vent opening defined therethrough, a duct arranged to convey an airflow therethrough defining an upstream portion and a downstream portion, the duct in fluid communication with the opening. A set of first louvers and a set of second louvers is disposed in the duct downstream of the vent opening, and a first louver positioning motor is coupled to the set of first louvers operative to selectively move the set of first louvers between a first position and a second position, and a second louver positioning motor coupled to the set of second louvers operative to selectively move the set of second louvers between a third position and a fourth position. The cooking appliance can also include a blower comprising a blower motor having a speed of operation selectable between at least a first speed and a second speed, the blower in fluid communication with duct and operative to draw the airflow through the duct from the upstream portion to the downstream portion. A controller module can be communicatively coupled to the blower motor, the first louver positioning motor, and the second louver positioning motor. The controller module is configured to: receive a first signal indicative of a value of a first parameter from a user interface, receive a second signal indicative of a measured a value of a second parameter from a sensor, and trigger at least one of a change in the blower motor speed of operation, a change in the position of the set of first louvers, and a change in the position of the set of second louvers, based on the value of the first parameter and the second parameter.

In another aspect, the present disclosure relates to a ventilation system. The ventilation system can include a duct arranged to convey an airflow therethrough and defining an upstream portion and a downstream portion, the duct in fluid communication with a vent opening defined in a cooking surface. The ventilation system can also include a set of first louvers and a set of second louvers disposed in the duct downstream of the vent opening; a first louver positioning motor coupled to the set of first louvers operative to selectively move the set of first louvers between a first position and a second position, and a second louver positioning motor coupled to the set of second louvers operative to selectively move the set of second louvers between a third position and a fourth position. The ventilation system can further include a blower comprising a blower motor having a speed of operation selectable between at least a first speed and a second speed, the blower in fluid communication with the duct and operative to draw the airflow through the duct from the upstream portion to the downstream portion; and a controller module communicatively coupled to the blower motor, the first louver positioning motor, and the second louver positioning motor. The controller module can be configured to: receive a first signal indicative of a value of a first parameter from a user interface, receive a second signal indicative of a measured value of a second parameter from a sensor, and trigger at least one of a change in the blower motor speed of operation, a change in the position of the set of first louvers, and a change in the position of the set of second louvers, based on the value of the first parameter and the second parameter.

In yet another aspect, the present disclosure relates to a method of operating a cooking appliance. The method includes arranging a duct in fluid communication with an aperture defined in a cooking surface, to convey an airflow therethrough to define an upstream portion and a downstream portion, disposing a set of first louvers in the duct, the first louvers selectively moveable between a first position and a second position via a first louver positioning motor; disposing a set of second louvers in the duct, the second louvers selectively moveable between a third position and a fourth position via a second louver positioning motor. The method can also include disposing a blower comprising a blower motor, having a speed of operation selectable between a first speed and a second speed, in fluid communication with the duct and operative to draw the airflow through the duct; coupling a controller module in signal communication with the blower motor, the set of first louver positioning motor, and the second louver positioning motor; receiving by the controller module, a first signal indicative of a value of a first parameter; receiving by the controller module, a second signal indicative of a measured a value of a second parameter; and triggering at least one of a change in the blower motor speed of operation, a change in the position of the set of first louvers, and a change in the position of the set of second louvers, based on the value of the first parameter and the second parameter.

DETAILED DESCRIPTION

Figure 1:
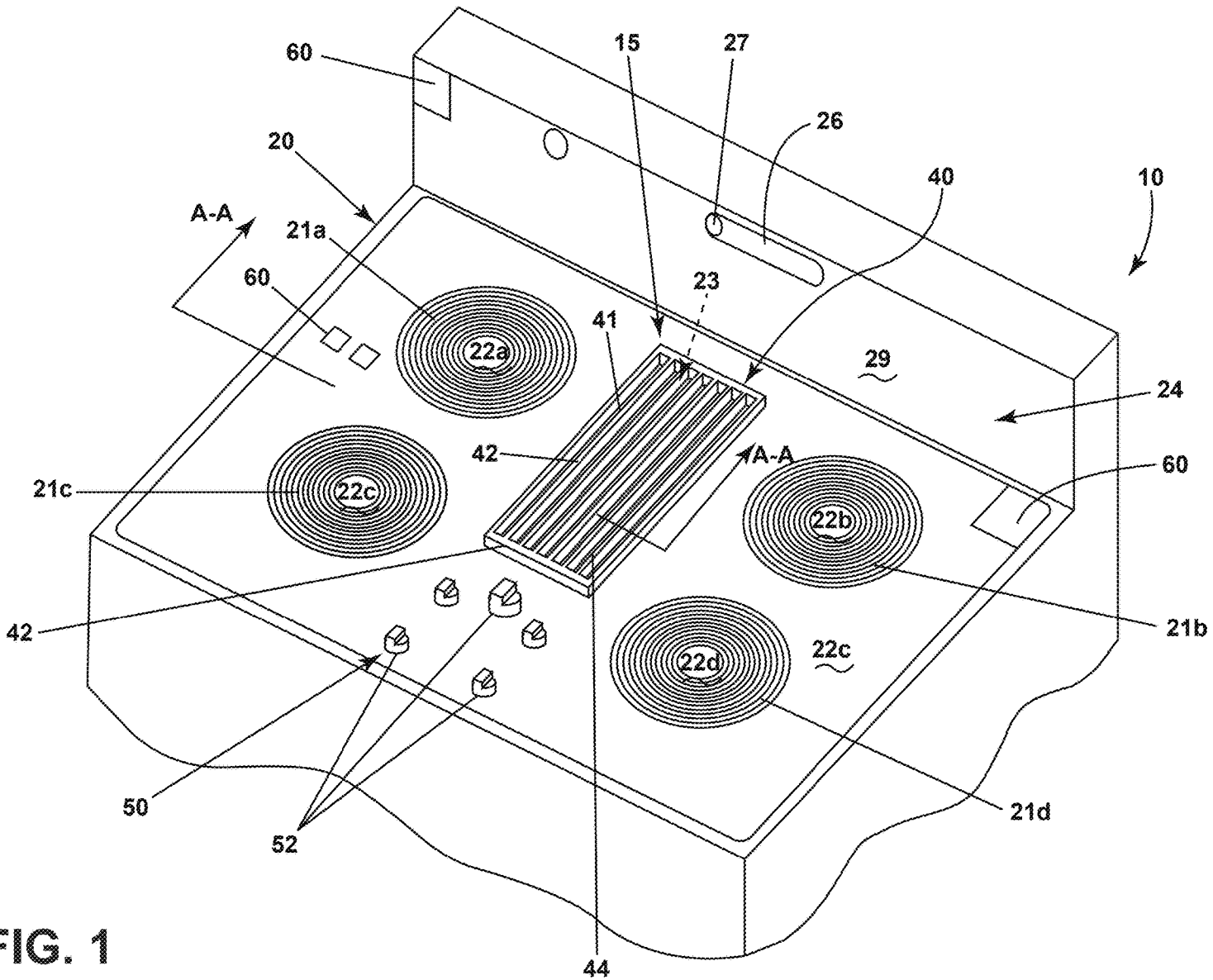
FIG. 1 illustrates a perspective view of a cooking appliance in accordance with a non-limiting aspect of the present disclosure.

In describing aspects illustrated in the drawings, specific terminology will be resorted to for the sake of clarity. However, it is not intended that the aspects be limited to the specific terms so selected and it is to be understood that each specific term includes all technical equivalents that operate in a similar manner to accomplish a similar purpose. For example, the words "connected," "attached," "coupled," and "mounted" and variations thereof herein are used broadly and encompass direct and indirect connections, attachments, couplings, and mountings. In addition, the terms "connected," "coupled," etc. and variations thereof are not restricted to physical or mechanical connections, couplings, etc. as all such types of connections should be recognized as being equivalent by those skilled in the art.

As used herein, the term "set" or a "set" of elements can be any non-zero number of elements, including only one. The exemplary drawings are for purposes of illustration only and the dimensions, positions, order and relative sizes reflected in the drawings attached hereto can vary.

Additionally, as used herein, a "processor", or "controller module" can include a component configured or adapted to provide instruction, control, operation, or any form of communication for operable components to affect the operation thereof. A processor or controller module can include any known processor, microcontroller, or logic device, including, but not limited to: Field Programmable Gate Arrays (FPGA), an Application Specific Integrated circuit (ASIC), a Proportional controller (P), a Proportional Integral controller (PI), a Proportional Derivative controller (PD), a Proportional Integral Derivative controller (PID controller), a hardware-accelerated logic controller (e.g. for encoding, decoding, transcoding, etc.), the like, or a combination thereof. Non-limiting examples of a controller module can be configured or adapted to run, operate, or otherwise execute program code to effect operational or functional outcomes, including carrying out various methods, functionality, processing tasks, calculations, comparisons, sensing or measuring of values, or the like, to enable or achieve the technical operations or operations described herein. The operation or functional outcomes can be based on one or more inputs, stored data values, sensed or measured values, true or false indications, or the like. While "program code" is described, non-limiting examples of operable or executable instruction sets can include routines, programs, objects, components, data structures, algorithms, etc., that have the technical effect of performing particular tasks or implement particular abstract data types. In another non-limiting example, a processor or controller module can also include a data storage component accessible by the processor, including memory, whether transient, volatile or non-transient, or non-volatile memory.

Additional non-limiting examples of the memory can include Random Access Memory (RAM), Read-Only Memory (ROM), flash memory, or one or more different types of portable electronic memory, such as discs, DVDs, CD-ROMs, flash drives, universal serial bus (USB) drives, the like, or any suitable combination of these types of memory. In one example, the program code can be stored within the memory in a machine-readable format accessible by the processor. Additionally, the memory can store various data, data types, sensed or measured data values, inputs, generated or processed data, or the like, accessible by the processor in providing instruction, control, or operation to affect a functional or operable outcome, as described herein. In another non-limiting example, a control module can include comparing a first value with a second value, and operating or controlling operations of additional components based on the satisfying of that comparison. For example, when a sensed, measured, or provided value is compared with another value, including a stored or predetermined value, the satisfaction of that comparison can result in actions, functions, or operations controllable by the controller module. As used herein, the term "satisfies" or "satisfaction" of the comparison is used herein to mean that the first value satisfies the second value, such as being equal to or less than the second value, or being within a predetermined value range of the second value. It will be understood that such a determination may easily be altered to be satisfied by a positive/negative comparison or a true/false comparison. Example comparisons can include comparing a sensed or measured value to a threshold value or threshold value range.

As used herein, the term "blower" or "downdraft blower" can refer to an apparatus having rotating blades or members, for example, a fan that operates to create an airflow or current of air for ventilation. Such blowers can have a single speed of rotation of the blades, or can have a speed of rotation of the blades that is selectable or adjustable between at least a low speed and a high speed. As used herein, the term "blower speed" or "speed of the blower" can refer to the speed of rotation of the rotating blades of the blower, and can include a rotational speed of zero.

Conventional blowers for cooking appliances are typically controlled by mechanical multi-position switches, potentiometers, or rheostat type controls, which enable a user to choose the blower speed. For example, to remove or ventilate normal cooking odors, steam, and other effluents and contaminates proximal a conventional cooktop appliance, a user may use a switch to selectively operate a conventional downdraft blower in a low-speed mode. Additionally, the user can use a switch to selectively operate the conventional downdraft blower in a high-speed mode, for example when using such items as a grill, to ventilate grease or smoke laden air from a kitchen and duct it to an outside environment. In still other cases, the user may choose to operate the cooking appliance with the downdraft blower in an off or non-operating condition.

In conventional cooking systems, such as cooktops and grills with proximity ventilation, cooking gases, vapors and odors are drawn into an exhaust inlet by the downdraft blower and are exhausted into the atmosphere. Usually, the exhaust inlet is located adjacent the cooking surface and the exhaust inlet is fluidly coupled to a flow path generally defined by a duct and which can serially include a plenum, the blower, an atmospheric exhaust, and interconnecting ductwork. In conventional cooking systems, the blower is rigidly mounted in the flow path at a predetermined fixed orientation and distance from the exhaust inlet. The flow path to the atmosphere normally extends through a wall or floor of the room in which the cooking system is located, but can also be exhausted into a room if filtered. Conventional blowers are typically arranged as a separate unit from the rest of the cook top and installed prior to the installation of the unit into a counter top. Some conventional blower systems are provided with a pair of brackets, which permits the selective mounting of the blower to the floor of the appliance itself for discharge either through a wall or through the floor, as required by the installation.

FIG. 1 illustrates a perspective view of a cooking appliance 10 having a downdraft ventilation system 15 in accordance with a non-limiting aspect. The cooking appliance 10 can be a cooktop having a cooking surface 20. The ventilation system can include a ventilator 40, a user interface 50 and a set of sensors 60. The cooking surface 20 can include a set of heated or heatable portions such as a first heatable portion 21*a*, a second heatable portion 21*b*, a third heatable portion 21*c*, and a fourth heatable portion 21*d*. The heatable portions 20*a*-20*d* can be proximal to, and heated by a respective heat source, 22*a*, 22*b*, 22*c*, and 22*d* (e.g., gas, resistive coil, inductive coil and the like). In non-limiting aspects, the cooking surface 20 can define a vent opening 23 therethrough. The heat source can include any desired type of source, such as an electric coil, a flame, and the like, and can be located on or under the cooking surface 20. In non-limiting aspects, the cooking appliance 10 can include a panel 29 such as a back splash panel. The panel 29 can optionally be disposed along an edge of the cooking surface 20, for example, for splash protection. In other aspects, the panel 29 can be disposed in any desired location on the cooking appliance 10 without departing from the scope of the disclosure, including, without limitation along a front or along a side of the cooking surface 20. The appliance 10 and cooking surface 20 can be comprised of a metal, glass, stone, plastic or other materials.

The ventilator 40 includes an exhaust inlet portion 44 which can be arranged proximal to the cooking surface 20 and in fluid communication with air space 24 above the cooking surface 20 including the air space 24 above and proximate top the heatable portions 21*a*, 21*b*, 21*c*, and 21*d* and the air space 24 above and proximate to the exhaust inlet portion 44. The exhaust inlet portion 44 is in fluid communication with a duct (not shown) for removing effluent and hot air from air space 24 in the immediate vicinity of the cooking surface 20. In some aspects, the ventilator exhaust inlet portion 44 can be disposed in the vent opening 23. In other non-limiting aspects, the exhaust inlet portion 44 can be defined by the vent opening 23. In other non-limiting aspects, the exhaust inlet portion 44 can be disposed above the cooking surface 20, and a duct (not shown) can extend through the vent opening 23 coupled in fluid communication with the exhaust inlet portion 44. The ventilator 40 can include a vent screen 41, disposed to cover at least a portion of the vent opening 23. As shown, in non-limiting aspects, the vent screen 41 can comprise a plate 42 defining a set of apertures 43 therethrough. The vent screen 41 can be disposed to overlie the exhaust inlet portion 44. The plate 42 can prevent ingress of food, grease, crumbs, or other contaminants into the ventilator 40, while the set of apertures 43, can enable an airflow 19 (FIG. 2) therethrough into the exhaust inlet portion 44. The vent screen 41 can be selectively removeable for cleaning. The vent screen 41 can be formed of metal, although glass, stone, plastic or other materials may be used.

Although not shown in FIG. 1, the ventilation system 15 can be installed adjacent to a cooking area (e.g., in a kitchen) and positioned adjacent to or coupled with the cooking appliance 10 and configured to capture and exhaust cooking emissions emanating from the cooking appliance 10. For example, in some aspects, the ventilation system 15 can be installed immediately adjacent to the cooking appliance 10. In some examples, at least some portions of ventilation system 15 can be installed substantially or completely under a counter surface (not shown) or the cooking surface 20.

As illustrated in FIG. 1, in non-limiting aspects, the user interface 50 can be disposed on the cooking surface 20. The user interface 50 can include, for example, slides or knobs 52 to enable a user to manually control, e.g., heat, provided to the heatable portions 21*a*-21*d* via the corresponding heat sources 22*a*-22*d*. Other aspects are not so limited, and the user interface 50 can additionally or alternatively comprise, without limitation, pushbuttons, keys, or an electronic interface such as a touch screen, and combinations thereof. As will be discussed in more detail herein, in non-limiting aspects, the user interface 50 can also enable a user to control other operations of the ventilation system 15. While FIG. 1 depicts the user interface 50 as disposed on the cooking surface 20, other aspects are not so limited. In other aspects, the user interface 50 can be disposed at any desired location, or combination of locations, on or remote from the appliance 10, including, without limitation, on the panel 29, or on a remote or mobile device (not shown), and communicatively coupled to the ventilation system 15. The panel 29 can optionally be used to support a lighting device 26 including a lighting control device 27. In non-limiting aspects, the set of sensors 60 can be disposed on or supported by the panel 29, the cooking surface 20, or both, or in any other desired location without departing from the scope of the disclosure herein.

Figure 2:
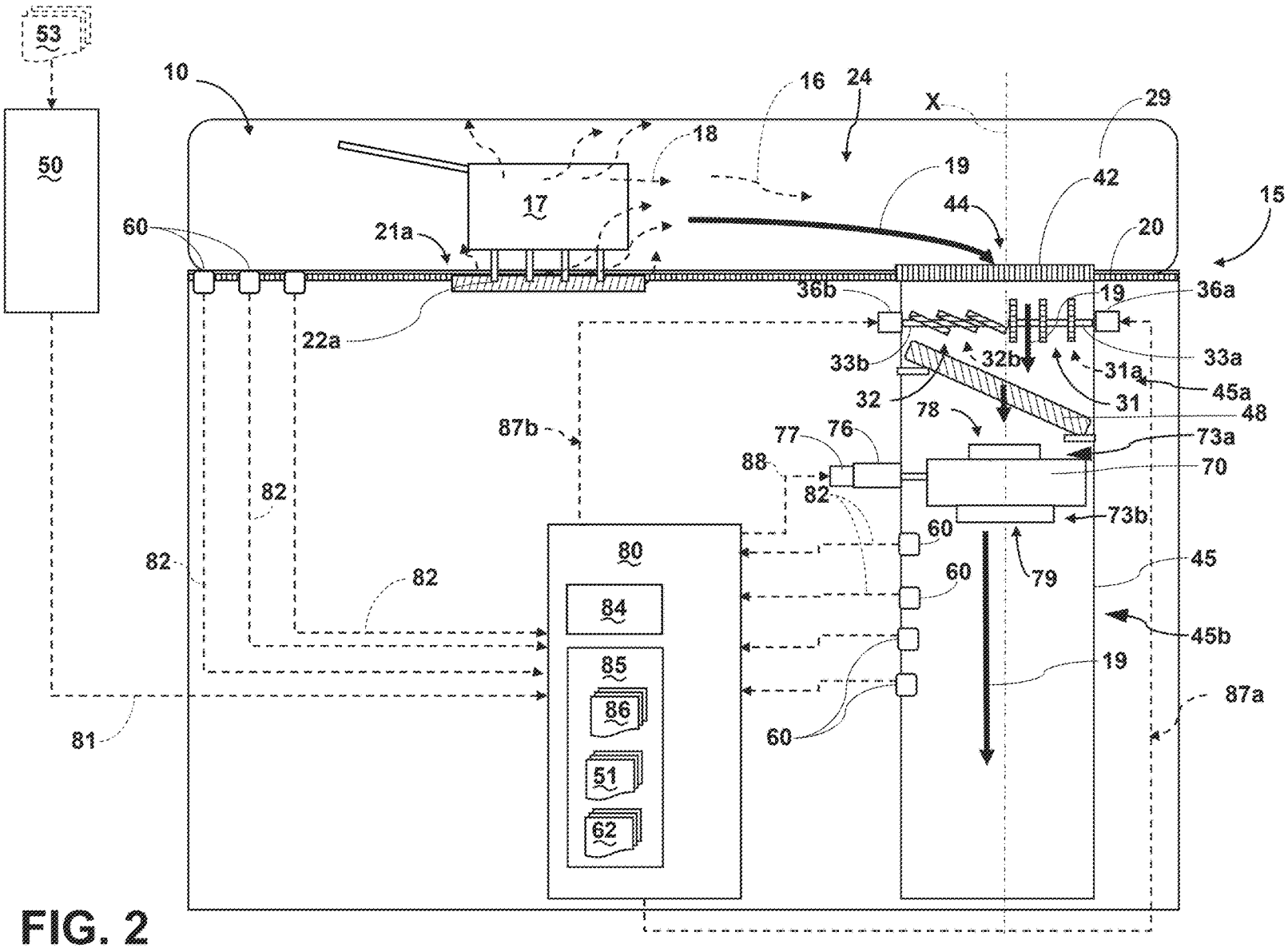
FIG. 2 illustrates a cutaway front view of the appliance of FIG. 1 along the line A-A, in accordance with a non-limiting aspect of the present disclosure.

FIG. 2 shows a cutaway of the aspect of FIG. 1 along the lines A-A with some parts shown in schematic form, for ease of description and understanding. In FIG. 2, additional elements of the ventilation system 15 not visible in FIG. 1 are shown. The additional elements can include the duct 45, a blower 70, a blower motor 76, a blower motor speed control 77, a set of first louvers 31, a set of second louvers 32, a first louver positioning motor 36*a*, a second louver positioning motor 36*b*, and a controller module 80. Non-limiting aspects can also include a filter 48 removably disposed with the duct 45. The duct 45 can be coupled in fluid communication with the exhaust inlet portion 44 to define an upstream portion 45*a* of the duct 45 proximal the exhaust inlet portion 44. The duct 45 can extend away from the cooking surface 20 along a longitudinal axis X, to define a downstream portion 45*b* of the duct 45 distal to the exhaust inlet portion 44. The set of first louvers 31 and set of second louvers 32 are disposed in the duct 45 downstream direction from the exhaust inlet portion 44. The blower 70 can be disposed downstream of the set of first louvers 31 and second set of louvers. The blower 70 is arranged in fluid communication with the duct 45 and the air space 24 above the cooking surface 20. In FIG. 2, cooking emissions 18 and ambient air 16 are illustrated as dashed arrows and are depicted as being drawn into an airflow 19 (illustrated as a series of solid arrows) operatively established by the blower 70, to be ventilated through the duct 45. The duct 45 is arranged in fluid communication with the vent opening 23 to receive the airflow 19, and to convey the airflow 19 therethrough from the upstream portion 45*a* to the downstream portion 45*b*.

The user interface 50 can be arranged to receive one or more user inputs 53 comprising a value of a first parameter 51, and to provide a first signal 81 indicative of the value of the first parameter 51 to the controller module 80. The set of sensors 60 can be configured to sense or measure a value of a respective second parameter 62 and further configured to provide a respective second signal 82 to the controller module 80 indicative of respective second parameter 62. The controller module 80 can include a processor 84 or other logic device communicatively coupled to a memory 85. The controller module 80 is configured to provide a speed control signal 88 to the blower motor speed control 77, a first position control signal 87*a* to the first louver positioning motor 36*a*, and a second position control signal 87*b* to the second louver positioning motor 36*b*.

The set of first louvers 31 and the set of second louvers 32 can comprise respective sets of elongated, relatively thin plates, blades, fins, slats, or baffles or combinations thereof. The set of first louvers 31 and the set of second louvers 32 can be disposed to extend horizontally across a width of the duct 45 (i.e. orthogonal to the longitudinal axis X). In other non-limiting aspects, the set of first louvers 31 and the set of second louvers 32 can alternatively be disposed to extend horizontally across a depth of the duct 45 (i.e. parallel to the longitudinal axis X).

The set of first louvers 31 and the set of second louvers 32 can be disposed within the duct 45 downstream of the vent screen 41. Mounting brackets or flanges (omitted for clarity) can be used to support the set of first louvers 31 and the set of second louvers 32 within the duct 45. It is contemplated that in other non-limiting aspects, the set of first louvers 31 and the set of second louvers 32 can be disposed within the duct 45 in a staggered arrangement with respect to each other, from upstream to downstream, without departing from the scope of the disclosure. The set of first louvers 31 can be rotatably coupled to the first louver positioning motor 36*a*. The set of second louvers 32 can be rotatably coupled to the second louver positioning motor 36*b*. In some non-limiting aspects, a first adjustment member 33*a* can be moveably coupled between the set of first louvers 31 and the first louver positioning motor 36*a*. Similarly, in some aspects, a second adjustment member 33*b* can be moveably coupled between the set of second louvers 32 and the second louver positioning motor 36*b*.

The set of first louvers 31 and the set of second louvers 32 can be independently moveable between at least two respective positions. It will be appreciated that the respective positions of the set of first louvers 31 and the set of second louvers 32 can affect the speed, volume, direction, and combinations thereof, of the airflow 19. That is, the respective positions of the set of first louvers 31 and the set of second louvers 32 can independently or cooperatively enable, limit, regulate, adjust, or redirect the airflow 19, and combinations thereof. For example, the set of first louvers 31 can be selectively movable between a first position 31*a* (e.g., an open position) and a second position 31*b* (e.g., a closed position, shown in FIG. 2*a*). The set of second louvers 32 can be selectively movable between a first position 32*a* (e.g., an open position, shown in FIG. 2A) and a second position 32*b* (e.g., a closed position). In non-limiting aspects, the set of first louvers 31 and the set of second louvers 32 can be selectively oriented in the same position as each other (e.g., both first and second sets of louvers 31, 32 in an open first position 31*a*, 32*a*), or selectively oriented in a different position from each other (e.g., one of the first and second sets of louvers 31, 32 in an open first position 31*a*, 32*a*, and the other in a closed second position 32*a*, 32*b*.

Figure 2A:
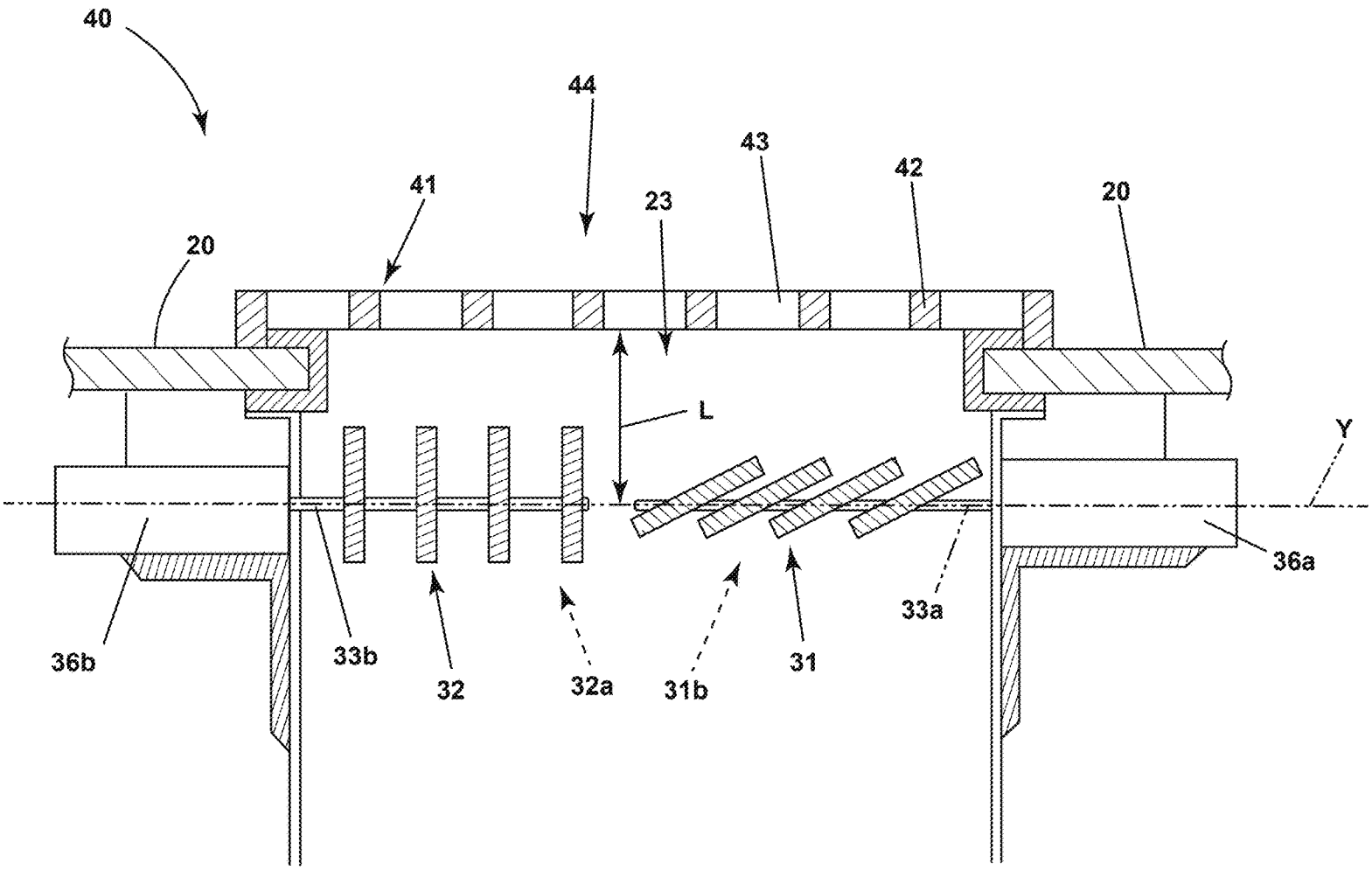
FIG. 2A illustrates a portion of a ventilation system with first and second louvers arranged in accordance with a non-limiting aspect of the present disclosure.

FIG. 2A depicts a more detailed view a portion of the upstream portion 45*a* of the duct 45 of ventilation system 15 of FIG. 2. The illustration of FIG. 2A is similar to the non-limiting aspect of FIG. 2, so like numbers will be used to reference like parts. One notable difference from is that in FIG. 2 the first and second louvers 31, 32 are illustrated as selectively oriented in different respective positions than depicted in FIG. 2, respectively. More specifically, FIG. 2A depicts the set of first louvers 31 in the closed second position 31*b*, and the set of second louvers 32 in the open first position 32*a*. As shown, the set of first louvers 31 and the set of second louvers 32 can be aligned with each other across a width of the duct 45 at a common longitudinal distance "L" from the cooking surface 20. In some aspects, the set of first louvers 31 and the set of second louvers 32 can be arranged to rotate around a respective axis (not shown) defined at a common longitudinal distance "L" from the cooking surface 20.

Figure 2B:
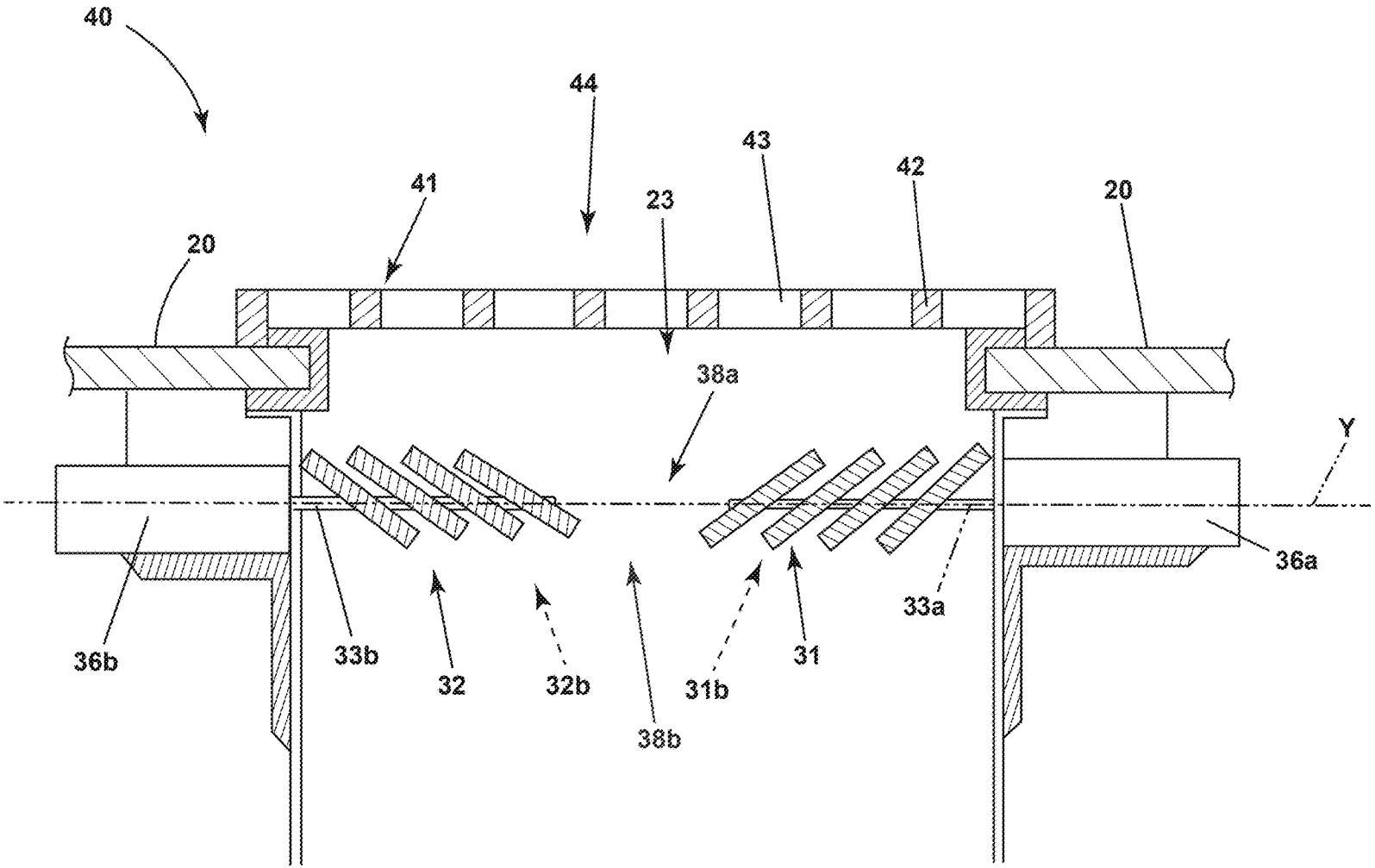
FIG. 2B illustrates the portion of the ventilation system of FIG. 2A depicting the first and second louvers arranged in accordance with another non-limiting aspect of the present disclosure.

Similarly, FIG. 2B depicts the same portion of the ventilation system 15 of FIG. 2A, with the first and second louvers 31, 32 oriented in different relative positions than in FIG. 2A. More specifically, FIG. 2B depicts both the set of first louvers 31 and the set of second louvers 32 selectively oriented in the closed second position 31*b*, 32*b*. As illustrated in FIG. 2B, the set of first louvers 31 and the set of second louvers 32 can be arranged within the duct 45 such that when disposed in the respective second positions 31*b*, 32*b*, the first and second louvers 31, 32 can cooperatively form or define a converging section 38*a* (e.g. a venturi inlet) and forms a diverging section 38*b* (e.g., a venturi outlet). Thus, the set of first louvers 31 and the set of second louvers 32 disposed within the duct 45 can cooperatively defines a fluid flow path that can exhibit characteristics similar to or the same as a typical venturi device.

While the set of first louvers 31 and the set of second louvers 32 are illustrated in FIGS. 2, 2*a*, and 2*b* and described herein, for ease of description and understanding, as selectively and independently moveable between the respective first position 31*a*, 32*a* and second position 31*b*, 32*b*, it is contemplated that in other non-limiting aspects are not so limited. In other aspects, the set of first louvers 31 and the set of second louvers 32 can be arranged to be moveable between any number of respective positions, without departing from the scope of the disclosure herein. For example, in some aspects at least one of the set of first louvers 31 and the set of second louvers 32 can be moveable between a first position 31*a*, 32*a* (e.g., an open position) and a second position 31*b*, 32*b* (e.g., a closed position) through a number of partially open, or partially closed positions (not shown).

The first louver positioning motor 36*a* can be arranged to selectively move or rotate the set of first louvers 31 between the first position 31*a* (e.g., an open position) and the second position 31*b* (e.g., a closed position). The second positioning motor 36*b* can be arranged to selectively move or rotate the set of second louvers 32 between the first position 32*a* (e.g., an open position) and the second position 32*b* (e.g., a closed position). As will be discussed in more detail herein, the orientation of the set of first louvers 31 and the set of second louvers 32 can function to optimize the airflow 19 into the duct 45 to advantageously affect cooking operations and the capture capacity of the ventilation system 15.

Referring again to FIG. 2, while the blower 70 is depicted as disposed within the duct 45, other aspects are not so limited. In other aspects, the blower 70 can be disposed outside the duct 45, such as in a plenum chamber (not shown) in fluid communication with the duct 45. It is contemplated that the blower 70 can be a conventional blower 70 comprising rotatable fan blades (not shown). The blower 70 can be configured to have a single speed of rotation of the fan blades speed of the blower 70. In such aspects, the blower 70 can be selectively adjustable between an OFF state, and a first blower speed. In other non-limiting aspects, the blower 70 can have a blower speed that is selectable or adjustable between at least first speed (e.g., a low speed) and a second speed (e.g., a high speed). In such aspects, the blower 70 can be selectively adjustable between an OFF state, and the first speed, and the second speed. As will be described in more detail herein, the speed of the blower 70 can be selected or adjusted based on a desired speed or airflow volume of the airflow 19 through the duct 45, the position of the set of first louvers 31, or the position of the set of second louvers 32, or combinations thereof to optimize the airflow 19 into the duct 45 to advantageously affect cooking operations and the capture capacity of the ventilation system 15.

The blower 70 can include a housing 73 that has a top or upstream portion 73*a* and a bottom or downstream portion 73*b*. The blower 70 upstream portion 73*a* can define an opening or air inlet 78. The air inlet 78 can be configured to receive the airflow 19 therethrough, which can contain smoke and fumes created during the cooking process. An inlet screen (not shown) can optionally be disposed across the air inlet 78 to prevent physical objects from going into the blower 70 or housing 73. The blower 70 downstream portion 73*b* can define an opening or air outlet 79. The air outlet 79 can be configured to discharge the airflow 19 therethrough from the blower 70. The blower 70 can include a power inlet or conduit box (omitted for clarity) and a blower motor speed control 77 for receiving electrical power to operate the blower motor 76. The blower motor speed control 77 can be communicatively coupled to the controller module 80 and the blower motor 76. The blower motor speed control 77 can be configured to control adjust the power (e.g., current) provided to the blower motor 76, in response to a speed control signal 88 from the controller module 80 to thereby adjust or regulate the blower motor 76 speed in a known manner.

The blower motor 76, can be any conventional motor such as a permanent-split capacitor ("PSC") motor. For example, in non-limiting aspects, the blower motor 76 can be a capacitor start and run motor comprising a starting capacitor inserted in series with the startup windings or second windings (not shown) connected to a power source, e.g., 120 Volts, 60 Hertz. (not shown). In other non-limiting aspects, the blower motor 76 can be an electronically commutated (EC) motor, having its speed regulated via the blower motor speed control 77 via conventional pulse width modulation (PWM) techniques. Other aspects are not so limited, and the blower motor 76 can be any desired motor, operating at any desired power, using any desired motor speed controller without departing from the scope of the disclosure.

The filter 48 can be disposed in the duct 45 upstream of the blower 70. The filter 48 can a conventional filter. The filter 48 can be mounted at an angle with respect to the longitudinal axis X to enable runoff of any grease or other unwanted materials from the filter 48.

The set of sensors 60 can be disposed in various locations within the cooking appliance 10 and communicatively coupled to the controller module 80. The set of sensors 60 can configured to sense, detect, measure, or otherwise determine a value of a respective second parameter 62. The sensors 60 can comprise any desired conventional sensor 60 including, but not limited to, a temperature sensor, a humidity sensor, a pressure sensor, a light sensor, a photo-electric sensor, a proximity sensor, a voltage sensor, a current sensor, a chemical sensor, a moisture sensor, an airflow sensor, a switch sensor, an odor sensor, a smoke detector, or combinations thereof. The sensors 60 can be arranged to provide a respective second signal 82 to the controller module 80 indicative of a value of a second parameter 62. The value of the second parameter 62 can be indicative of a status of the cooking appliance 10 or the ventilation system 15 or both. The set of sensors 60 can be configured to provide a respective second signal 82 to the controller module 80 indicative of the respective sensed or measured value of the second parameters 62 detected or measured by the sensors 60.

The controller module 80 can be coupled in signal communication with the user interface 50 to receive the first signal 81 therefrom. The controller module 80 can also receive the second signal 82 from the set of sensors 60. The controller module 80 can be further communicatively coupled to the first louver positioning motor 36*a*, to provide a first position control signal 87*a* thereto. The controller module 80 can be further communicatively coupled to the second louver positioning motor 36*b*, to provide a second position control signal 87*b* thereto. The controller module 80 can be further communicatively coupled to the blower motor 46, to provide a speed control signal 88 thereto. The controller module 80 can be disposed within the cooking appliance 10 in any desired location without departing from the scope of the disclosure herein. Alternatively, it is contemplated that the controller module 80 can be configured for wireless communication with the ventilation system 15, and can be disposed remote from the appliance 10 without departing from the scope of the disclosure.

The memory 85 can be configured to store a set of desired values 86. The set of desired values 86 can include predetermined desired values 86 associated with or corresponding to a predetermined optimal condition or desired status of the cooking appliance 10, the ventilation system, or both. For example, the set of desired values 86 can be indicative of various target or desired speeds of the blower 70, desired positions of the first louvers 31, or desired positions of the second louvers 32, or combinations thereof. The target or desired speeds of the blower 70, positions of the first louvers 31, or positions of the second louvers 32, or combinations thereof can be based on the desired values 86. In non-limiting aspects, the target or desired speeds of the blower 70 can include an OFF condition of the blower, a first speed of the blower 70, or a second speed of the blower 70. The desired positions of the first louvers 31 can include the first position 31*a*, and the second position 32*b*. The desired positions of the second louvers 32 can include the first position 32*a*, and the second position 32*b*. In non-limiting aspects, the desired values 86 can also include default settings for the blower speed 70, or default positions of the first louvers 31 or second louvers 32, or combinations thereof during an operation of the cooking appliance 10.

Additionally, or alternatively, the set of desired values 86 can include calculated desired values 86 associated with or corresponding to a predetermined optimal condition or desired status of the cooking appliance 10, the ventilation system, or both. For example, in non-limiting aspects, the processor can be configured to calculate, estimate, or otherwise determine the set of desired values 86 in real-time. In non-limiting aspects, the desired values 86 can be selectable by the controller module 80 from the memory 85, or calculated, estimated, or otherwise determined by the processor 84, or both, based on the user inputs 53 received from the user interface 50, or values of respective second parameters 62 received from the set of sensors 60, or combinations thereof.

With continued reference to FIG. 2, in operation, cooking emissions 18 (e.g., steam) from a utensil or cooking vessel 17, and hot ambient air 16 proximal to the vessel 17 and cooking surface 20 can be drawn into the airflow 19 and through the exhaust inlet portion 44 into the duct 45 using the blower 70. By selectively positioning the first and second sets of louvers 31, 32, or adjusting the blower speed, or a combination thereof, based on one or more user inputs 53 and sensed or measured second parameters 62, the fluid flow characteristics of the cooking emissions 18 and ambient air 16 into and through the duct 45, can be optimized. In this way, aspects as described herein can result in an improved capture efficiency of the ventilation system 15, improved temperature control of the cooking appliance 10, and more efficient heating and stable cooking temperatures can be obtained, compared to conventional cooking appliances with typical downdraft venting arrangements. For example, in one non-limiting instance, the rate of rise of a temperature of a cooking vessel 17 can be better controlled to reduce stresses on the cooking vessel 17 that would result from an undesirably rapid temperature increase. In another non-limiting instance, the volatility of temperature swings during a cooking operation, such as a "searing event" can be reduced. Unlike conventional cooking and ventilation systems, non-limiting aspects as described herein can prevent an undesired reduction of a cooking temperature by selectively adjusting or reducing the speed, volume, or direction of a flow of cool air proximal the cooking vessel. Conversely, non-limiting aspects can also prevent an undesired increase in a cooking temperature by selectively adjusting or increasing the speed, volume, or direction of a flow of cool air proximal the cooking vessel 17. As will be described in more detail herein, non-limiting aspects can be operative to enable selective adjustment at least one of the speed, volume, or direction of the airflow 19 to thereby stabilize the temperature of the cooking surface 20 or cooking vessel 17 or both.

For example, a user may desire to heat a food item (not shown), for example placed in the vessel 17 such as a pot located on a heatable portion 21*a*-21*d* of the cooking surface 20, or a food item (not shown) located on a heatable portion 21*a*-21*d* (such as a grill portion) of the cooking surface 20. The user can manually select or otherwise provide the user input 53 indicative of a value of one or more first parameters 51, such as a heat setting, via the user interface 50. The user interface 50 can provide the first signal 81 indicative of the value of the first parameters 51 to the controller module 80. The controller module 80 can store the value of the first parameters 51 in the memory 85. For example, in various aspects, the value of the first parameters 51 can include a relative heat setting (e.g., a low, a medium, or a high heat) for a particular heatable portion 21*a*-21*d* of the cooking surface 20. In other non-limiting aspects, the of the value of the first parameters 51 can include a particular temperature for a particular heatable portion 21*a*-21*d* of the cooking surface 20. In non-limiting aspects, the user input 53 can be indicative of a respective value of a set of first parameters 51. For example, in non-limiting aspects, the set of first parameters 51 can additionally or alternatively include, without limitation, one or more of a user-selected blower speed (e.g., a low, a medium, or a high speed), a selected heatable portion 21*a-d,* a selected heat source 22*a-d,* a food type (e.g., meat, soup, etc.), a food state (e.g., liquid, frozen, etc.), a vessel type (e.g., a pot, a grill, etc.), a vessel material (e.g., steel, cast iron, ceramic, etc.), a cooking time duration, (e.g., 1-hour) a cooking operation (boil, simmer, etc.), and combinations thereof. Regardless of the particular first parameters 51 selected or provided by the user, the respective values of the first parameters 51 can be provided by the user interface 50 as at least one first signal 81 to the controller module 80 and stored in the memory 85.

Additionally, in operation, the set of sensors 60 can provide the set of second signals 82 to the controller module 80 indicative of a measured or detected value of one or more of the set of respective second parameters 62. In non-limiting aspects, the set of second parameters 62 can include, without limitation, a temperature (e.g., of air) within the duct 45, an ambient temperature external to the duct 45, a relative humidity within the duct 45, a relative humidity external to the duct 45, an airflow volume within the duct 45, an air pressure within the duct 45, an air pressure external to the duct 45, a relative amount of a volatile organic compound (VOC) in the duct 45, a temperature of the cooking surface 20, a temperature of the cooking vessel 17, a change in the temperature of the cooking vessel 17, a position of the set of first louvers 31, a position of the set of second louvers 32, a speed of the blower 70, a status of one or more of the heat sources 22*a*-22*d,* a temperature of one or more of the heatable portions 21*a*-21*d,* or various combinations thereof.

In operation, the processor 84 can select the set of desired values 86 from the memory 85 based on the first signal 81 and the second signal 82. Additionally, or alternatively, the processor 84 can calculate or otherwise determine the set of desired values 86, or both, based on the first signal 81 and the second signal 82. For example, the controller module 80 can determine the value of the first parameters 51 and the value of the second parameters 62, based on the first and second signals 81, 82, respectively. The desired values 86 can then be selected from memory 85 by the controller module 80 based on the determined values of the first parameters 51, or the value of the second parameters 62, or a combination thereof. In non-limiting aspects, the desired values 86 can also be calculated or otherwise determined by the processor 84, based on the value of the first parameters 51, or the value of the second parameters 62, or a combination thereof. For example, the processor 84 can be configured to perform a comparison of the value of the first parameters 51 with the value of the second parameters 62 and based on the comparison, select the desired values 86 from memory 85. In other non-limiting aspects, the set of desired values 86 can additionally or alternatively be calculated or estimated, by the controller module 80 based on predetermined ratios, algorithms, equations, look-up tables, or the like, based on the value of the first parameters 51, or the value of the second parameters 62, or a combination thereof.

Based on the selected desired values 86, the controller module 80 can further determine a target or desired speed of the blower 70, a desired position of the first louvers 31, or a desired position of the second louver 32, or a combination thereof. In non-limiting aspects, the controller module 80 can further execute a comparison of the desired values 86, with a current speed of the blower 70, a current position of the first louvers 31, or a current position of the second louver 32, respectively. Based on the comparison, the controller module 80 can determine whether the current speed of the blower 70 or position of the first and second louvers 31, 32 satisfies the desired values 86. In the event that the current speed of the blower 70 or the position of the first or second louvers 31, 32 do not satisfy the desired values 86, the controller module 80 can further trigger an adjustment or change in the speed of the blower 70, position of the set of first louvers 3, or position of the second set of louvers 32, or a combination thereof.

For example, in the event the speed of the blower 70 or the position of the first or second louvers 31, 32, do not satisfy the desired values 86, the controller module 80 can provide the speed control signal 88 to the blower motor speed control 77, the first position control signal 87*a* to the first louver positioning motor 36*a,* or the second position control signal 87*b* to the second louver positioning motor 36*b* or combinations thereof. The speed control signal 88 can cause the blower motor speed control 77 to adjust the speed of the blower motor 76 to satisfy with the desired values 86. Similarly, the first position control signal 87*a* can cause the first position control motor 36 to adjust to adjust or change the position of the set of first louvers 31 to satisfy the desired values 86. Likewise, the second position control signal 36*b* can cause the second position control motor 36 to adjust to adjust or change the position of the set of second louvers 32 to satisfy the selected desired values 86.

Figure 3:
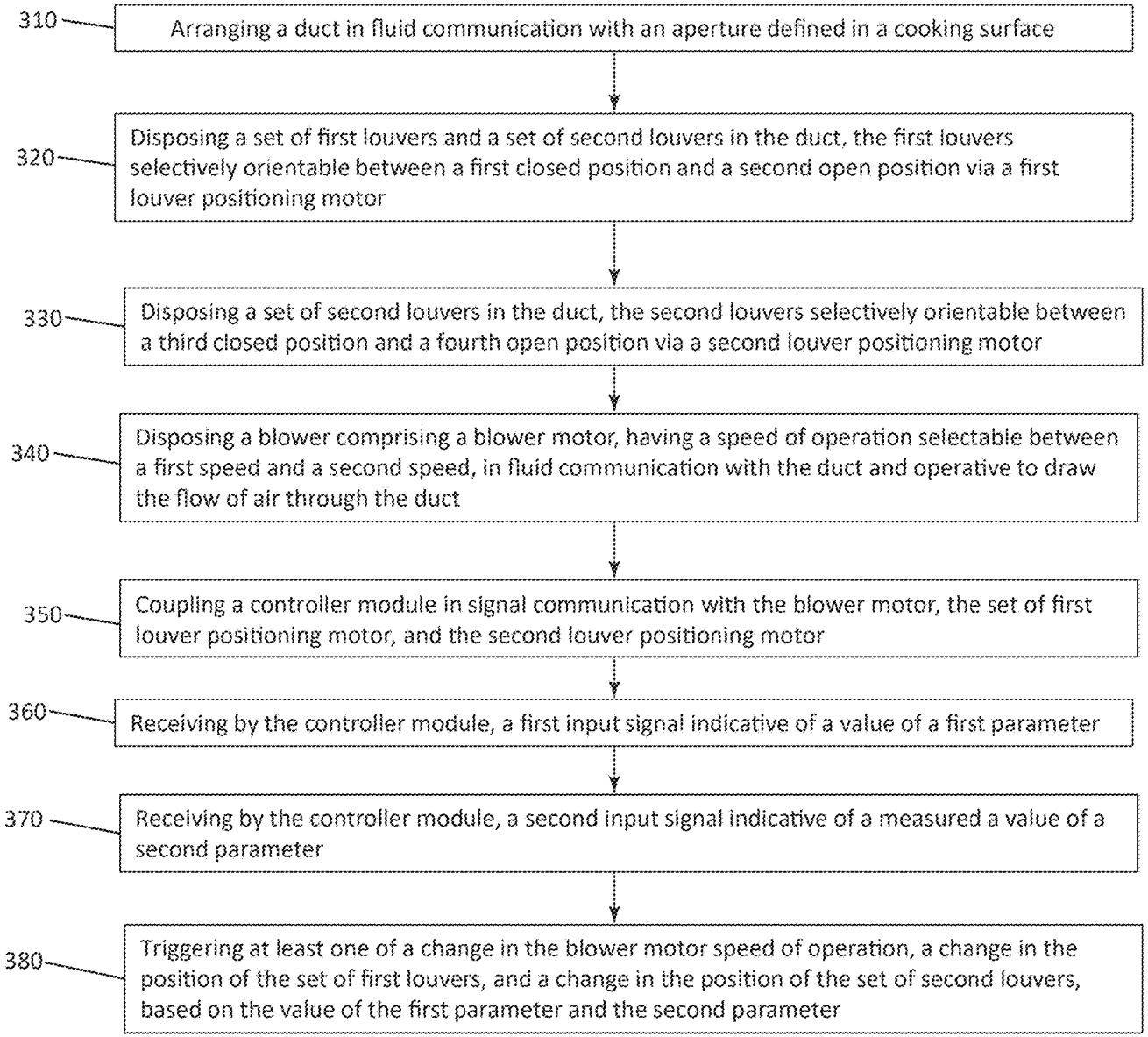
FIG. 3 illustrates a flowchart depicting exemplary steps of a method of ventilating a cooking appliance in accordance with a non-limiting aspect of the present disclosure.

FIG. 3 illustrates a non-limiting example of a method 300 of to ventilate a cooking appliance 10, for example using the ventilation system 15 of FIG. 2. Although the ventilation system 15 is described herein in terms of a cooking appliance 10, it will be appreciated that the method 300 can be applied to any suitable appliance or ventilation system. While the method 300 will be described with reference to the ventilation system 15 and cooking appliance 10 of FIG. 2, other aspects are not so limited and the method 300 can be implemented using any other ventilation system 15 and cooking appliance 10 without departing from the scope of the disclosure herein.

In non-limiting aspects, the method 300 can begin at step 310, by arranging the duct 45 in fluid communication with the vent opening 23 defined in the cooking surface 20 of the cooking appliance 10. The method 300 can include, at step 320, disposing the set of first louvers 31 in the duct 45 and at step 330 disposing the set of second louvers 32 in the duct 45. The set of first louvers 31 and the set of second louvers 32 can be independently moveable between at least two respective positions to independently or cooperatively enable, limit, regulate, or redirect the airflow 19, and combinations thereof. For example, the set of first louvers 31 can be selectively movable between the first position 31*a* (e.g., an open position) and the second position 31*b* (e.g., a closed position). The set of second louvers 32 can be selectively movable between the first position 32*a* (e.g., an open position) and the second position 32*b* (e.g., a closed position). For example, the first positioning motor 36*a* can be arranged to selectively move or rotate the set of first louvers 31 between the first position 31*a* and the second position 31*b*. The second positioning motor 36*b* can be arranged to selectively move or rotate the set of second louvers 32 between the first position 32*a* and the second position 32*b*.

The method 300 can include, at step 340, disposing a blower 70, in fluid communication with the duct 45 and operative to draw the flow of air 19 through the duct. The blower 70 can comprise a blower motor 76 having a speed of operation selectable between a first speed and a second speed. The blower 70 can be disposed downstream of the set of first louvers 31 and second set of louvers. The blower 70 can be in fluid communication with the duct 45 and the air space 24 above the cooking surface 20. The blower 70 can include a motor speed controller 77 to receive electrical power to operate the blower motor 76.

The method can continue, at step 450, by coupling a controller module 80 in signal communication with the blower motor 76, the set of first louver positioning motor 36*a,* and the second louver positioning motor 36*b*. At step 360, the method can include receiving by the controller module 80, a first signal 81 indicative of a value of a first parameter 51, and at step 470, receiving by the controller module 80, a second signal 82 indicative of a measured a value of a second parameter 62.

The method 300 can include, at 480, triggering at least one of a change in the blower motor 76 speed of operation, a change in the position of the set of first louvers 31, and a change in the position of the set of second louvers 32, based on the value of the first parameter 51 and the value of the second parameter 62.

The sequence depicted is for illustrative purposes only and is not meant to limit the method 300 in any way as it is understood that the portions of the method can proceed in a different logical order, additional or intervening portions can be included, or described portions of the method can be divided into multiple portions, or described portions of the method can be omitted without detracting from the described method.

To the extent not already described, the different features and structures of the various aspects can be used in combination with each other as desired. That one feature is not illustrated in all the aspects is not meant to be construed that it is not included, but is done for brevity of description. Thus, the various features of the different aspects can be mixed and matched as desired to form new aspects of the disclosure, whether the new aspects are expressly described. All combinations or permutations of features described herein are covered by this disclosure.

This written description uses examples to disclose aspects of the disclosure, including the best mode, and to enable any person skilled in the art to practice the aspects of the disclosure, including making and using any devices or systems and performing any incorporated methods. The patentable scope of the disclosure is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A cooking appliance comprising:

a cooking surface having a set of heatable portions and a vent opening defined therethrough and positioned adjacent to the set of heatable portions;

a downdraft ventilation system configured to draw an airflow downward through the vent opening in the cooking surface, the downdraft ventilation system comprising:

a duct arranged to convey the airflow therethrough and defining an upstream portion and a downstream portion, the duct in fluid communication with the vent opening;

a set of first louvers disposed in the duct;

a set of second louvers disposed in the duct;

a first louver positioning motor coupled to the set of first louvers operative to selectively move the set of first louvers between a first position and a second position;

a second louver positioning motor coupled to the set of second louvers operative to selectively move the set of second louvers between a third position and a fourth position;

a blower comprising a blower motor having a speed of operation selectable between at least a first speed and a second speed, the blower in fluid communication with the duct and operative to draw the airflow through the duct from the upstream portion to the downstream portion; and a controller module communicatively coupled to the blower motor, the first louver positioning motor, and the second louver positioning motor, the controller module configured to:

receive a first signal indicative of a value of a first parameter from a user interface;

receive a second signal indicative of a measured value of a second parameter from a sensor; and trigger at least one of a change in the blower motor speed of operation, a change in the position of the set of first louvers, or a change in the position of the set of second louvers, based on the value of the first parameter and the second parameter;

wherein the set of first louvers is spaced from the set of second louvers to define one of a converging section or a diverging section between the set of first louvers and the set of second louvers.

2. The cooking appliance of claim 1, wherein the controller module is further configured to select a set of predetermined desired values from a memory based on the value of the first parameter and the value of the second parameter, and wherein the at least one of the change in the blower motor speed of operation, the change in the position of the set of first louvers, or the change in the position of the set of second louvers is based on the set of predetermined desired values.

3. The cooking appliance of claim 1, wherein the controller module is further configured to calculate a set of desired values based on the value of the first parameter and the value of the second parameter, and wherein the at least one of the change in the blower motor speed of operation, the change in the position of the set of first louvers, or the change in the position of the set of second louvers is based on the set of desired values.

4. The cooking appliance of claim 1, wherein the first parameter is at least one of a heat setting or a blower motor speed.

5. The cooking appliance of claim 4, wherein the first parameter is the heat setting, and wherein the heat setting is one of a low heat, a medium heat, or a high heat.

6. The cooking appliance of claim 1, wherein the second parameter includes at least one of an ambient temperature external to the duct, an air pressure within the duct, and air pressure external to the duct, a relative amount of a volatile organic compound (VOC) in the duct, or a change in temperature of a cooking vessel.

7. The cooking appliance of claim 1, further comprising a set of sensors communicatively coupled to the controller module, wherein the second signal is provided via the set of sensors.

8. The cooking appliance of claim 1, wherein the vent opening is positioned between the set of heatable portions, wherein at least some heatable portions of the set of heatable portions are positioned adjacent to the set of first louvers, and wherein at least some heatable portions of the set of heatable portions are positioned adjacent to the set of second louvers.

9. The cooking appliance of claim 1, wherein when the set of first louvers are in the second position and the set of second louvers are in the fourth position, the set of first louvers and the set of second louvers define the converging section between the set of first louvers and the set of second louvers.

10. The cooking appliance of claim 9, wherein when the set of first louvers are in the first position and the set of second louvers are in the third position, the set of first louvers and the set of second louvers define the diverging section between the set of first louvers and the set of second louvers.

11. A ventilation system comprising:

a duct arranged to convey an airflow therethrough and defining an upstream portion and a downstream portion, the duct in fluid communication with a vent opening defined in a cooking surface;

a set of first louvers extending partially across the duct;

a set of second louvers disposed in the duct downstream of the vent opening;

a first louver positioning motor coupled to the set of first louvers operative to selectively move the set of first louvers between a first position and a second position;

a second louver positioning motor coupled to the set of second louvers operative to selectively move the set of second louvers between a third position and a fourth position;

a blower comprising a blower motor having a speed of operation selectable between at least a first speed and a second speed, the blower in fluid communication with the duct and operative to draw the airflow through the vent opening to the duct from the upstream portion to the downstream portion; and a controller module communicatively coupled to the blower motor, the first louver positioning motor, and the second louver positioning motor, the controller module configured to:

receive a first signal indicative of a value of a first parameter from a user interface;

receive a second signal indicative of a measured value of a second parameter from a sensor; and trigger at least one of a change in the blower motor speed of operation, a change in the position of the set of first louvers, or a change in the position of the set of second louvers, based on the value of the first parameter and the second parameter;

wherein the set of first louvers is spaced from the set of second louvers to define one of a converging section or a diverging section between the set of first louvers and the set of second louvers.

12. The ventilation system of claim 11, wherein the controller module is further configured to select a set of predetermined desired values from a memory based on the value of the first parameter and the value of the second parameter, and wherein the at least one of the change in the blower motor speed of operation, the change in the position of the set of first louvers, or the change in the position of the set of second louvers is based on the set of predetermined desired values.

13. The ventilation system of claim 11, wherein the controller module is further configured to calculate a set of desired values based on the value of the first parameter and the value of the second parameter, and wherein the at least one of the change in the blower motor speed of operation, the change in the position of the set of first louvers, or the change in the position of the set of second louvers is based on the set of desired values.

14. The ventilation system of claim 11, wherein the first parameter is at least one of a temperature and a blower motor speed.

15. The ventilation system of claim 11, wherein the second parameter includes at least one of an ambient temperature external to the duct, an air pressure within the duct, and air pressure external to the duct, a relative amount of a volatile organic compound (VOC) in the duct, or a change in temperature of a cooking vessel.

16. The ventilation system of claim 11, wherein the user interface is a mobile device.

17. The ventilation system of claim 11, further comprising a set of sensors communicatively coupled to the controller module, wherein the second signal is received from the set of sensors.

18. A method of operating a downdraft ventilation system for a cooking appliance having a user interface and at least one sensor, the method comprising:

arranging a duct in fluid communication with an aperture defined in a cooking surface, to convey an airflow therethrough to define an upstream portion and a downstream portion;

disposing a set of first louvers in the duct and extending partially across the duct, the first louvers selectively moveable between a first position and a second position via a first louver positioning motor;

disposing a set of second louvers in the duct, the second louvers selectively moveable between a third position and a fourth position via a second louver positioning motor;

disposing a blower comprising a blower motor, having a speed of operation selectable between a first speed and a second speed, in fluid communication with the duct and operative to draw the airflow through the duct;

coupling a controller module in signal communication with the blower motor, the set of first louver positioning motor, and the second louver positioning motor;

receiving by the controller module from the user interface, a first signal indicative of a value of a first parameter;

receiving by the controller module from the at least one sensor, a second signal indicative of a measured value of a second parameter; and triggering at least one of a change in the blower motor speed of operation, a change in the position of the set of first louvers, and a change in the position of the set of second louvers, based on the value of the first parameter and the second parameter;

wherein the set of first louvers is spaced from the set of second louvers to define one of a converging section or a diverging section between the set of first louvers and the set of second louvers.

19. The method of claim 18, further comprising:

selecting, by the controller module, a set of predetermined desired values from a memory based on the value of the first parameter and the value of the second parameter, and wherein the triggering the at least one of the change in the blower motor speed of operation, the change in the position of the set of first louvers, and the change in the position of the set of second louvers, is based on the set of predetermined desired values.

20. The method of claim 18, further comprising:

calculating, by the controller module, a set of desired values from a memory based on the value of the first parameter and the value of the second parameter, and wherein the triggering the at least one of the change in the blower motor speed of operation, the change in the position of the set of first louvers, and the change in the position of the set of second louvers, is based on the set of desired values.

* * * * *